US005178379A

United States Patent [19]

Edwards et al.

[11] Patent Number: 5,178,379

[45] Date of Patent: Jan. 12, 1993

[54] SHEET COLLATOR WITH ALIGNMENT APPARATUS

[75] Inventors: Robert J. Edwards, Ridgefield; Kenneth W. Lowell, Farmington, both of Conn.

[73] Assignee: Pitney Bowes Inc., Stamford, Conn.

[21] Appl. No.: 734,420

[22] Filed: Jul. 23, 1991

[51] Int. Cl.[5] ..... B65H 29/34

[52] U.S. Cl. ..... 271/189; 271/220; 271/198; 271/207; 414/789; 414/790.7

[58] Field of Search ..... 271/246, 253, 273, 189, 271/207, 176, 198, 199, 3.1, 220; 414/789, 790.7

[56] References Cited

U.S. PATENT DOCUMENTS

| | | | |
|---|---|---|---|
| 2,984,482 | 5/1961 | Kist et al. | 271/246 X |
| 3,072,397 | 1/1963 | Kelchner | 271/53 |
| 3,263,992 | 8/1966 | Schrempp | 271/246 |
| 3,785,256 | 1/1974 | Nikkel | 93/930 |
| 4,078,790 | 3/1978 | Stocker | 271/213 |
| 4,621,966 | 11/1986 | Luperti et al. | 414/43 |
| 4,640,506 | 2/1987 | Luperti et al. | 271/212 |
| 4,799,663 | 1/1989 | Golicz | 271/199 |
| 4,805,891 | 2/1989 | Luperti et al. | 271/212 |
| 4,925,180 | 5/1990 | Golicz | 271/198 |
| 4,925,362 | 5/1990 | Golicz | 414/790.7 |
| 5,029,845 | 7/1991 | Simpson-Davis | 271/273 X |
| 5,080,347 | 1/1992 | Funada | 271/246 X |

FOREIGN PATENT DOCUMENTS 0027835 2/1986 Japan ..... 271/246

*Primary Examiner*—H. Grant Skaggs
*Assistant Examiner*—Carol Lynn Druzbick
*Attorney, Agent, or Firm*—Charles R. Malandra, Jr.; Melvin J. Scolnick

[57] ABSTRACT

An improvement in a collating machine for stacking sheets of paper fed seriatim from a singulating feeder in the same order as the sheets appear in the singulating feeder. The collating machine includes at least one upper belt and one lower belt for frictionally engaging and transporting the sheets, and ramp structure for lifting a succeeding sheet of paper over and onto a preceding, stopped sheet to form a collation. The improvement comprises a device for stopping each of the sheets, including at least one straight, vertical member against which the leading edge of each sheet abuts while the collation is being accumulated. The ramp structure and the stopping device are the upstream and downstream ends of a stacking section in the collating machine. There is a device, adjacent the stopping device, for transporting the collation from the stacking section. The transporting device is engaged when a last sheet has been stacked to form the collation, wherein the stopping device withdraws to allow the collation to pass when the transport device is engaged.

10 Claims, 5 Drawing Sheets

SHEET COLLATOR WITH ALIGNMENT APPARATUS

FIELD OF THE INVENTION

The present invention relates to a collating machine and more particularly to a collating machine having the capability of stacking material to form large collations for further processing in an inserting machine

BACKGROUND OF THE INVENTION

Collating machines accumulate documents, for example, burst or cut documents from a continuous, perforated web which is fed into the machine and guided towards a path for further processing, such as folding and insertion into envelopes. In inserter systems, such as the Pitney Bowes 8300 Series Inserters, collating machines are used in-line with other paper handling equipment as a means of assembling a plurality of sheets of paper into a particular, desired packet prior to further processing, which may include additional collating, folding and inserting. In a typical paper handling sequence involving an initial output consisting of a plurality of sheets of paper, to be later combined with subsequent output from other sheet feeding devices situated downstream, the initial output is fed from a first feeding device, for example, a burster or cutter, seriatim to the collator, which collates the output into desired packets. Each packet may then be folded, stitched or subsequently combined with other output from document feeding devices located downstream thereof and ultimately inserted into a mailing envelope. For further background, reference can be made to U.S. Pat. Nos. 3,935,429, 4,547,856 and 4,733,359.

Examples of collating machines used in inserter systems are disclosed in U.S. Pat. Nos. 4,805,841 and 4,640,506 which disclose collators having the capability to collate in standard or reverse order. Collating machines are also disclosed in U.S. Pat. Nos. 4,799,663, 4,925,180 and 4,925,362. The collating machines disclosed in the aforementioned patents use an upper and lower belt and pulley configuration to convey sheets into and collations out of the collating machine. Stop/-registration wheels are used to stop the forward progress of the sheets being accumulated to form the collation. The stop/registration wheels are wheels which have a section cut out to provide a flat vertical surface which abuts a flat horizontal surface for stopping and aligning the leading edge of the sheets to form a collation. When the last sheet of a collation is accumulated, the stop/registration wheels rotate towards the downstream direction so that the belts can remove the collation.

An inherent problem with the aforementioned collating machines is that the lead edge alignment is not maintained as the collation is removed from the collating machine The stop/registration wheels have been found to be unsuitable for maintaining lead edge alignment when the wheels rotate as the collation is removed from the collating machine.

The operation of the aforementioned collating machines deteriorates as the size of a collation increases. Typically, problems are encountered relating to controlling large collations as they are removed from the collating machine. Although the belt and pulley configuration is suitable for conveying sheets to form a collation and for removing a small collation, for example of five to seven sheets, the belt and pulley configuration is not suited for handling large collations. For collations of fifteen or more sheets, the belt and pulley configuration loses control of the collation as it is removed resulting in shingling or stalling the machine.

The stop/registration wheels employed in the aforementioned collating machines have proved to be unsuitable for maintaining lead edge alignment as the collation is removed. As a solution to this problem, the stop/-registration wheels were eliminated and upper and lower pinch rollers were added to serve the twofold purpose of stops and drive rollers. The pinch rollers were situated at the downstream end of the belt and pulley configuration. The advancing sheets being collated were stopped at the nip of the pinch rollers. This caused the lead edge of the collation to be shingled as the sheets were accumulated. When the collation was to be removed from the collation stack area, the pinch rollers were actuated via a clutch mechanism to drive the collation out. As the drive rollers were actuated, the upper rollers pivoted up to allow the collation to pass. Although this structure works well for accumulating collations of up to fifteen sheets, it is not suitable for larger collations. Furthermore, this structure requires that lead edge alignment of the collation be performed downstream from the collating machine.

In U.S. Pat. No. 4,621,966, there is shown a shingle compensating device used in a collation machine whereby the collation is removed from the collating machine by a first and second pair of feed rollers with one pair of feed rollers acting as a positive drive and the second pair of feed rollers acting as the alignment mechanism. This collating device does not provide a lead edge alignment mechanism, but teaches the intentional shingling the leading edges of the collated material so that they can be later aligned in a buckle chute folding device.

Each of the aforementioned collating machines requires a means for aligning the leading edges of the collation downstream from the collating machine because of the lack of control of the sheets leaving the collator or because of the problems associated with aligning the mechanism in the nip of the downstream belts and pulleys of the collating machine. Accordingly, the present invention provides a collating machine with an alignment mechanism that aligns the collated sheets as the collation is formed and a device for better controlling the documents as the collation is removed from the collating machine.

SUMMARY OF THE INVENTION

It has been found that the present invention provides the capability to handle larger accumulations of material then has heretofore been experienced with the aforementioned collating machines. The present invention also includes the capability to handle large collations of a variety of sheet material, for example, sheets having embossed borders, which have heretofore been difficult to handle in collating machines.

It has been found that the present invention provides a significant advantage over the stop/registration wheels disclosed in the aforementioned collating machines, in that, control of the material leaving the collating apparatus is maintained. The use of a rotary solenoid engaging pinch rollers to cooperatively assist drive rollers to remove a collation provides uniform control over the collation as it leaves the collating machine. In accordance with the present invention an improvement in a collating machine for stacking sheet of paper fed seriatim from a singulating feeder in the same order as the sheets appear in the singulating feeder is provided. The collating machine includes at least one upper belt and one lower belt for frictionally engaging and transporting the sheets, and ramp structure for lifting a succeeding sheet of paper over and onto a preceding, stopped sheet to form a collation. The improvement comprises a device for stopping each of the sheets, including at least one straight, vertical member against which the leading edge of each sheet abuts while the collation is being accumulated. The ramp structure and the stopping device are the upstream and downstream ends of a stacking section in the collating machine. There is a device, adjacent the stopping device, for transporting the collation from the stacking section. The transporting device is engaged when a last sheet has been stacked to form the collation, wherein the stopping device withdraws to allow the collation to pass when the transport device is engaged.

BRIEF DESCRIPTION OF THE DRAWINGS

A complete understanding of the present invention maybe obtained from the following detailed description of the preferred embodiment thereof, when taken in conjunction with the accompanying drawings wherein like reference numerals designate similar elements in the various figures, and in which.

DESCRIPTION OF THE PREFERRED EMBODIMENT

Figure 1:
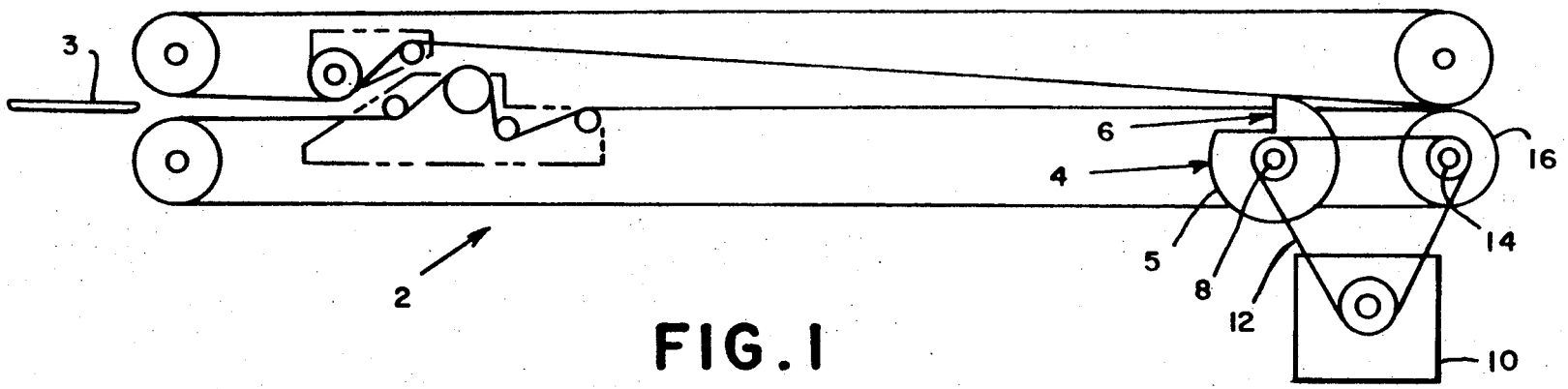
FIG. 1 (PRIOR ART)
FIG. 1 is a side elevational view of a prior art in-line collating machine.
Figure 2:
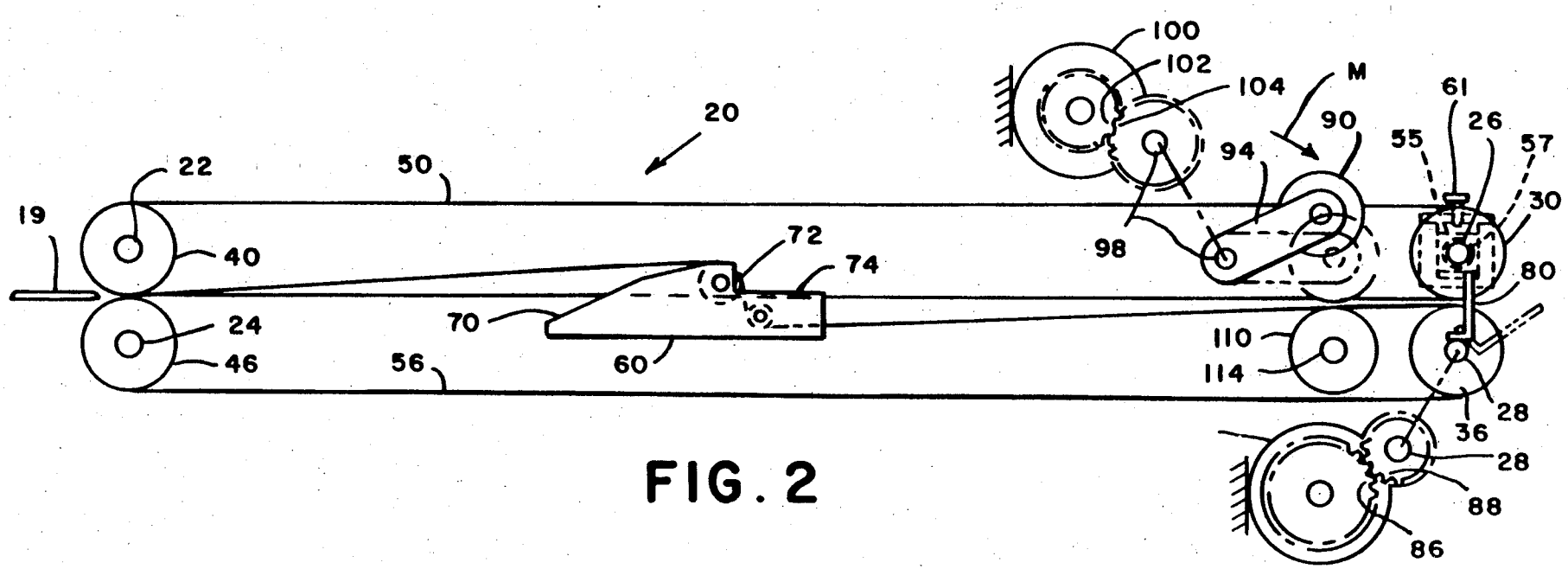
FIG. 2 is a side elevational view of an in-line collating machine in accordance with the present invention.
Figure 3:
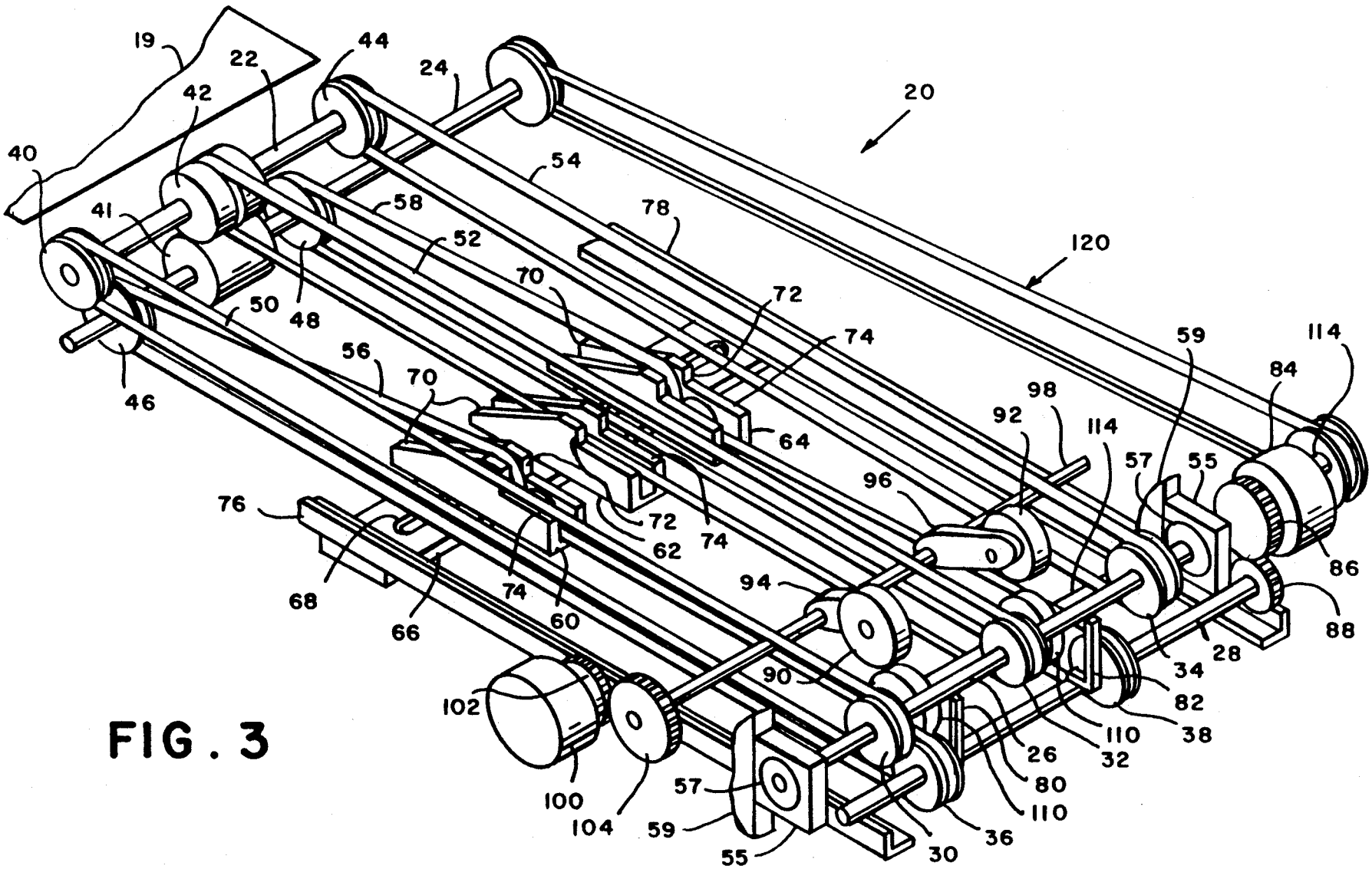
FIG. 3 is a perspective view of the collating machine seen in FIG. 1.
Figure 4:
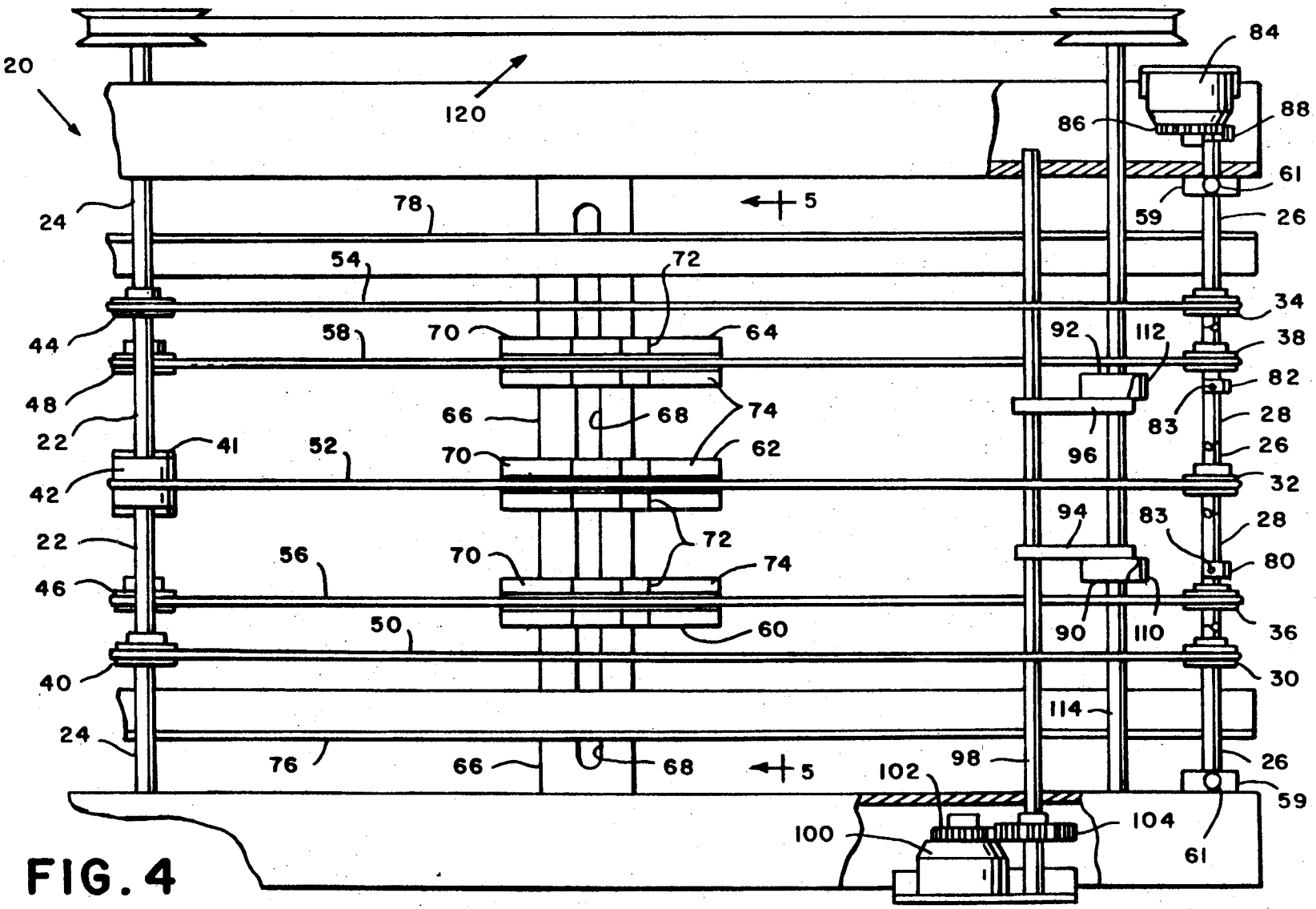
FIG. 4 is a top plan view of the collating machine seen in FIG. 3.

Referring to the drawings, FIG. 1 shows a prior art collating machine, generally designated 2, for conveying a supply of sheets 3 seriatim from a singulating feeder (not shown) to collating machine 2, where collations of sheets 2 are accumulated and then conveyed for further processing. The collating machine 2 is capable of accumulating a plurality of sheets in standard or reverse order. There a cyclable registration device 4 consisting of a pair of discs 5, each of which includes a vertical face 6. The discs 5 are fixably secured to a shaft 8 rotatably mounted in the side panels (not shown) of the collating machine 2. There is a motor 10 which is provided with a drive member 12 which in turn appropriately engages the shafts 14 and 8 in order to drive pulley 16 and the discs 5. An electromagnetic clutch (not shown) is provided to activate the discs 5 at appropriate times. When the collating machine 2 has accumulated the required number of sheets 3 in the registered position at the cyclable registration device 4, a predetermined electronic control device (not shown) provides power to the an electromagnetic clutch (not shown) which then rotatably engages the shaft 8 having the discs 5 mounted coaxially therewith. The clutch is rotatably coupled to the drive member 12 and the accumulated sheets is then advanced along a path downstream of collating machine 2 for subsequent operations. This device has experienced problems in maintaining the vertical alignment of the lead edge during the removal of collations from the collating machine.

In describing the preferred embodiment of the present invention, reference is made to FIGS. 2 through 7 wherein there is seen a collating machine, generally designated 20, for accumulating into collations sheets 19 conveyed from a singulating feeder (not shown), and for conveying the collations downstream for further processing. Collating machine 20 comprises sidewall frame members (not shown) for housing the structure of collating machine 20. There are three driven shafts 22, 24 and 114 of which shafts 24 and 114 are suitably journaled to the frame members. Shafts 24 and 114 are operatively connected to a conventional drive system 120. Rollers 42 and 41 are secured to shafts 22 and 24 respectively. Shaft 22 is driven by the friction drive of rollers 42 and 41.

There is a pair of bearing holders 55 connected to the frame members. Each end of shaft 26 is mounted in a pair of ball bearings 57 which are seated in a bearing holder 55 which in turn is mounted in bearing holder block 59. Accordingly, shaft 26 may move or pivot upwards when a thick collation is being accumulated. The pivot action occurs about the center of shaft 26. Bearing holders 55 are weighted so that a gravity force is always bearing upon the sheets 19 being conveyed. Each bearing holder 55 includes a screw 61 which can raise or lower shaft 26 to adjust the amount of drive pressure on collations as required. For larger collations, the lowest position of shaft 26 can be preset by adjusting screw 61 to set bearing blocks higher. As collation 19 exits this area, shaft 26 floats freely in an upward direction while the gravity force remains constant. This structure avoids sheet jams by eliminating excessive drive pressure on collation 19.

Three idler pulleys 30, 32 and 34 are rotatably mounted on shaft 26 and two idler pulleys 36 and 38 are rotatably mounted on shaft 28. Two drive pulleys 40 and 44 are secured to shaft 22, and two drive pulleys 46 and 48 are secured to drive shaft 24. In addition to driving shaft 22, roller 42 operates as a pulley for driving belt 52 which is suspended on roller 42 and pulley 32. There is a groove in the center of the urethane surface of roller 42 for this purpose.

Suitable, upper, endless, elastic conveyor belts 50, 52 and 54 are suspended on pulleys 30 and 40, 32 and (roller) 42, and 34 and 44 respectively. Similarly, suitable, lower, endless belts 56 and 58 are suspended on pulleys 36 and 46, and 38 and 48, respectively. In the preferred embodiment of the present invention, belts 50, 52, 54, 56, and 58 are o-ring belts.

Figure 5:
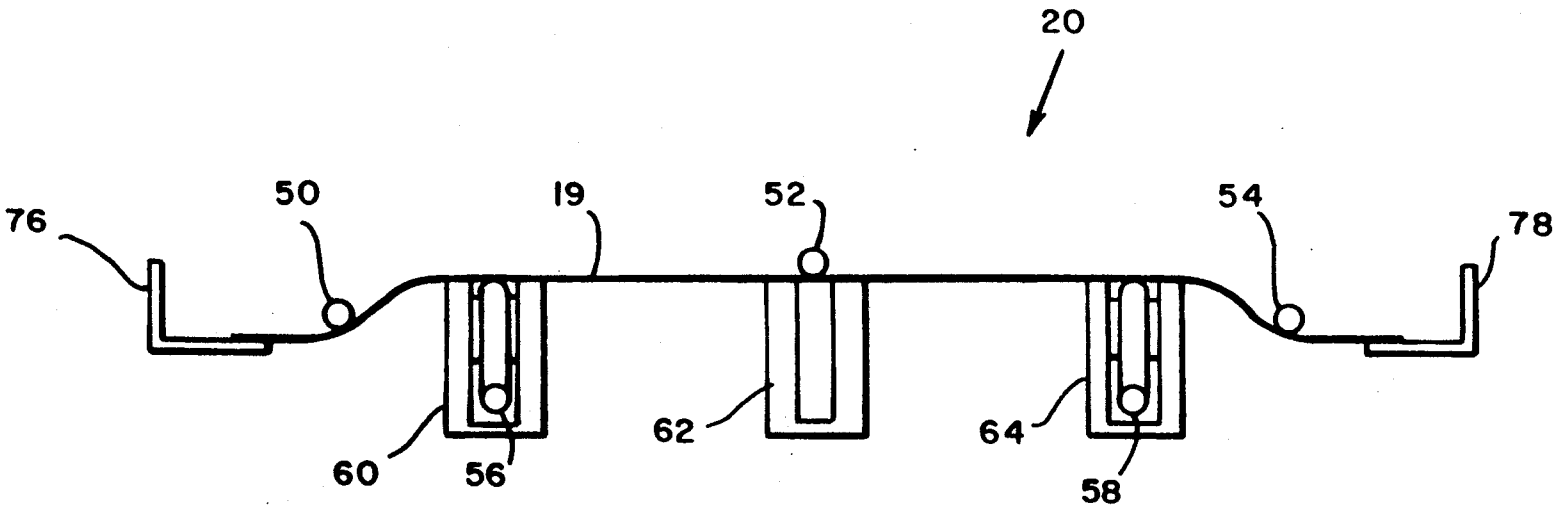
FIG. 5 is a front view taken along lines 5—5 in FIG. 4 showing a sheet being conveyed to the collation stack.

Three ramp guide blocks 60, 62 and 64 are mounted to mounting plate 66 which is transversely secured between the frame members (not shown). Blocks 60, 62 and 64 are slidable transversely owing to bolts (not shown) which fit through channel 68 in mounting plate 66 for securely mounting blocks 60, 62 and 64. In the preferred embodiment of the present invention, ramp guide blocks 60, 62 and 64 include a lower inclined end 70 on the upstream end for intercepting a leading edge of sheet 19 as it is conveyed, and vertical and horizontal surfaces 72 and 74 respectively on the downstream end. It has been found that the optimum position for ramp guide blocks 60, 62 and 64 is to position one at each of the lower belts 56 and 58, wherein the upper reach of each lower belt is threaded through rollers or bearings located within a channel situated through the middle of the outer guide blocks 60 and 64. The middle guide block is positioned under or adjacent the center upper belt 52. As best seen in FIG. 5, this configuration provides a positive gripping of each sheet as it is conveyed to the collation stack. Side guides 76 and 78 serve the twofold purpose of maintaining proper side alignment of the sheets as they are conveyed and assist in the gripping of the sheets by belts 50 and 54 by providing an outer deck surface for the outside edges of the sheets.

Figure 6:
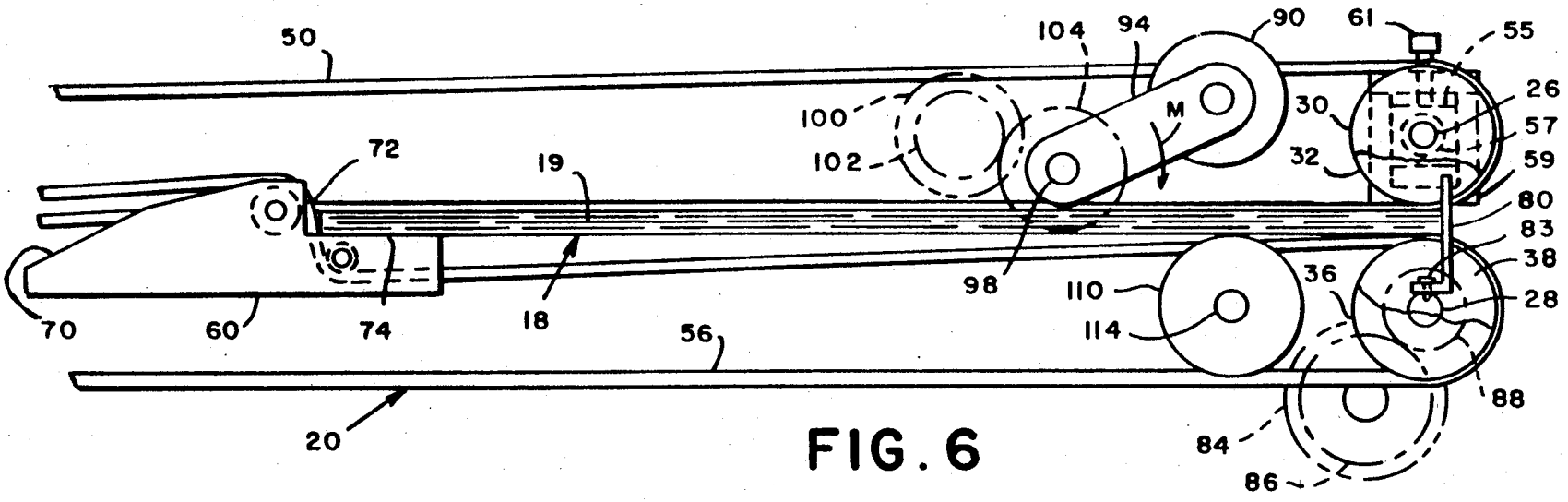
FIG. 6 is a side elevational view of the collating machine seen in FIG. 4 showing a collation before removal
Figure 7:
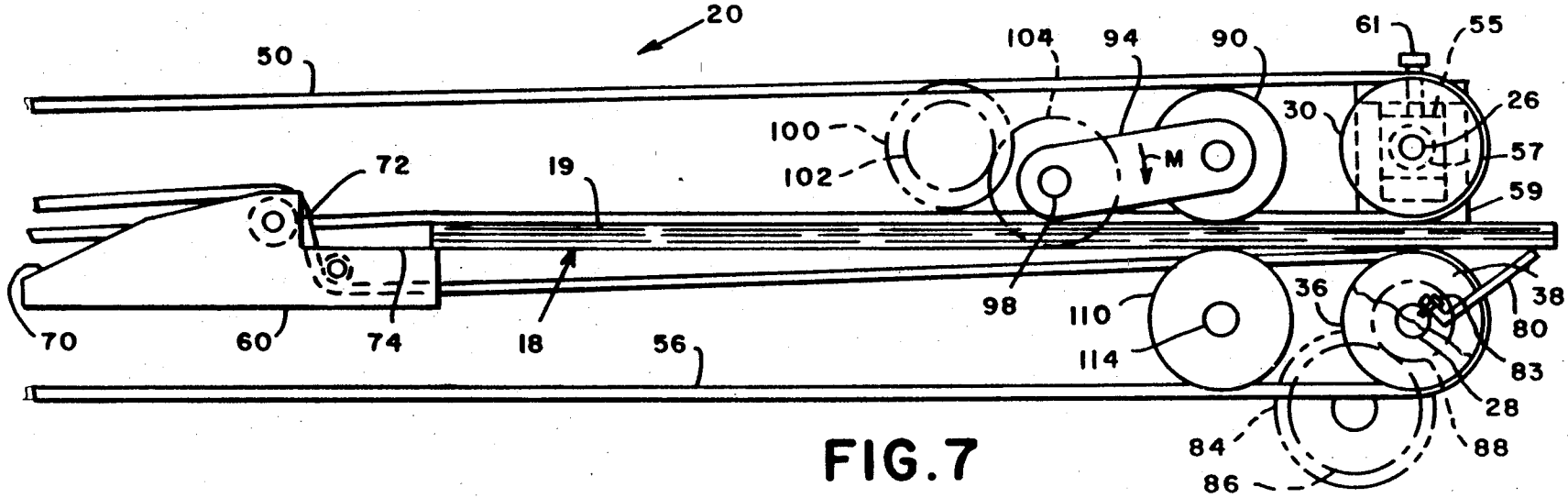
FIG. 7 is the same as FIG. 6 except that the collation is being removed.

There are a pair of rotary actuated stops 80 and 82, which are mounted on the surface of shaft 28 by screws 83. The rotary motion of stops 80 and 82 are controlled by rotary solenoid 84 and gears 86 and 88. When a collation is being accumulated, solenoid 84 is disengaged and stops 80 and 82 are in an upright position for squarely aligning the leading edges of the sheets. In the preferred embodiment of the present invention, stops 80 and 82 are one half inch wide and two and a half inches high. As best seen in FIG. 6, ramp guide blocks 60, 62 and 64 are situated so that there is sufficient room between stops 80 and 82 and the vertical abutment surfaces 72 of ramp guide blocks 60, 62 and 64. The result of this spacing of blocks 60, 62 and 64 with respect to stops 80 and 82 is that each succeeding sheet 19 is deposited on top of the preceding sheet 19, resulting in a collation 18 having sheets 19 therein appearing in the same order as conveyed from the singulating feeder (not shown). The sheets 19 of collation 18 come to rest in sharp, vertical alignment against stops 80 and 82.

There are a pair of rotary actuated pinch rollers 90 and 92 which are idler rollers rotatably attached to one end of arms 94 and 96 respectively. Arms 94 and 96 are rigidly connected at the other end to shaft 98 which is suitably journaled to sidewall frame members (not shown). The rotation of shaft 98 is controlled by rotary solenoid 100 through gears 102 and 104. When the last sheet of a collation has been stacked, solenoid 100 is engaged and shaft 98 rotates causing pinch rollers 90 and 92 to rotate downward against collation 18 with a constant torque M. Pinch rollers 90 and 92 are situated such that when solenoid 100 is engaged, pinch rollers 90 and 92 operate cooperatively with drive rollers 110 and 112 which are mounted on shaft 114 and driven in a conventional manner. In the preferred embodiment of the present invention, drive rollers 110 and 112 are situated upstream from stops 80 and 82. The pinch between pinch rollers 90 and 92 and drive rollers 110 and 112 is not critical because the torque applied to pinch rollers 90 and 92 by solenoid 100 is constant and sufficient to ensure adequate control of collation 18. In the preferred embodiment of the present invention, the pinch is set by securing arms 94 and 96 to shaft 98 when pinch rollers 90 and 92 are resting against drive rollers 110 and 112 respectively and solenoid 100 engaged.

In operation, collating machine 20 receives sheets 19 seriatim from the singulating feeder. While each collation 18 is being accumulated, solenoids 84 and 100 are disengaged and stops 80 and 82 are in a vertical, upright position and pinch rollers 90 and 92 are in a raised position apart from drive rollers 110 and 112. Each sheet 19 is conveyed by upper belts 50, 52 and 54 and lower belts 56 and 58 cooperatively gripping sheet 19 as it enters collating machine 20. Sheet 19 is conveyed over ramp guide blocks 60, 62 and 64 and continues until the leading edge rests against stops 80 and 82. This pattern of operation continues until the last sheet of collation 18 is stacked at which time solenoids 84 and 100 are engaged causing shafts 28 and 98 to rotate respectively. In the preferred embodiment of the present invention, the gear ratio between solenoid 100 and shaft 98 and between solenoid 84 and shaft 2 causes shaft 98 to rotate at one half the speed of shaft 28, thereby ensuring that pinch rollers 94 and 96 do not pinch collation 18 against drive rollers 110 and 112 before stops 80 and 82 have rotated down. The force applied by pinch rollers against collation 18 provides the necessary positive drive to ensure that the square alignment of the leading edge of the collation will be maintained for collations of at least thirty sheets or more.

Rotary solenoid 100 applies a torque "M" at pinch rollers 90 and 92 and thereby provides fairly uniform force against collation stack 18. The normal force is constant regardless of the thickness of collation stack 18. The torque is fairly constant when the solenoid is energized. In the preferred embodiment of the present invention, a 24-volt rotary solenoid is used for actuating both the pinch rollers 90 and 92 and the rotary stops 80 and 82. An example of the rotary solenoid that can be used in the present invention is a 24 volt rotary solenoid model 9039 manufactured by Lucas Lendix of Lendex Inc., a subsidiary of Lucas Industries of Vandalia, Ohio.

In the preferred embodiment of the present invention, the linear speed of the collation stack a the stack is removed from the collating machine is 120 inches per second. The linear speed of the upper and lower belts operate approximately 62 inches per second or one half of the speed of the sheets when controlled by rollers 110 and 112 and pinch rollers 90 and 92. In the preferred embodiment of the present invention, a two to one ratio of speeds between the speed of rollers 110 and 112 and the speed of belts 50, 52, 54, 56 and 58 is preferred. However, other ratios and other speeds could be used.

It has been found that the pinch rollers acting in operative association with a pair of driven rollers provides a means for maintaining positive control over the collation stack for the purpose of maintaining the stack alignment. It has further been found that the use of rotary actuated vertical stops eliminates the shingling of sheets of the collation that were caused when the stop/-registration wheels were eliminated. The combination of the pinch roller and driven roller with the vertical stops has proved to provide a means of aligning the sheets vertically and then removing the sheets while maintaining the alignment.

While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. In a collating machine for receiving individual sheets seriatim and stacking the sheets to form a collation, said collating machine having at least one upper, endless, elastic belt and one lower, endless, elastic belt, each of said belts having an upper and a lower reach, and wherein the lower reach of the upper belt is situated slightly above the upper reach of the lower belt to thereby frictionally engage and transport the sheets of paper along a paper path, and further having ramp means for lifting a succeeding sheet of paper over and onto a preceding, stopped sheet of paper to form the collation, means for stopping each sheet of paper in a stacking area located between said ramp means and said stopping means, and means for transporting the collation from the stacking area, the improvement wherein:

said stopping means comprises at least one stop rigidly mounted on a first rotatable shaft, the rotation of the first shaft being controlled by a first solenoid, said stop extending in a vertical direction for stopping the sheets when said first solenoid is deactivated, said stop pivoting away from the sheets when said first solenoid is activated; and said transporting means comprises at least one pair of upper and lower feed rollers, one of said rollers being a driven roller having a fixed position between said ramp means and said stop, the other of said rollers being a pressure roller rotatably mounted to one end of a crank arm, the other end of said crank arm being rigidly mounted to a second rotatable shaft, said second shaft being controlled by a second solenoid wherein said pressure roller engages the collation and applies a force against said driven roller when said second solenoid is activated, and wherein said pressure roller withdraws from engaging the collation when said second solenoid is deactivate.

2. The improvement according to claim 1, wherein said first rotatable shaft has at least one idler pulley rotatably mounted thereon, said idler pulley engaging one of said endless elastic belts.

3. The improvement according to claim 2, wherein said lower, endless, elastic belt is suspended on said idler pulley.

4. The improvement according to claim 1, wherein said first and second solenoids are rotary type solenoids.

5. The improvement according to claim 1, wherein said second solenoid applies a generally constant torque to said pressure roller whereby a generally constant force is applied against any size collation.

6. The improvement according to claim 1, wherein said first and second solenoid are simultaneously activated when the last sheet of the collation is stacked.

7. The improvement according to claim 6, wherein said first shaft rotates at twice the speed as said second shaft.

8. The improvement according to claim 1, wherein the downstream section of the upper belt is suspended on a pulley mounted on a third shaft, said third shaft being movable in an upward and downward direction for accommodating the removal of collations containing different number of sheets.

9. The improvement according to claim 1, wherein said pressure roller is the upper feed roller and said driven roller is the lower feed roller.

10. In a collating machine for receiving individual sheets of paper seriatim and stacking the sheets to form a collation, said collating machine having a plurality of upper, endless, elastic belts and a plurality of lower, endless, elastic belts, each of said belts having an upper and a lower reach, and wherein the lower reach of the upper belts is situated slightly above the upper reach of the lower belts to thereby frictionally engage and transport the sheets of paper along a paper path, and further having ramp means for lifting a succeeding sheet of paper over and onto a preceding, stopped sheet of paper to form the collation, means for stopping each sheet of paper in a stacking area located between said ramp means and said stopping means, and means for transporting the collation from the stacking area, the improvement wherein:

said stopping means comprises a pair of stop bars rigidly mounted on a first rotatable shaft, said first shaft having mounted thereon idler pulleys for the lower elastic belts, the rotation of the first shaft being controlled by a first solenoid, said stops extending in a vertical direction for stopping the sheets when said first solenoid is deactivated, said stops pivoting away from the sheets when said first solenoid is activated; and said transporting means comprises two pairs of upper and lower feed rollers, each of said pairs of rollers including a driven roller having a fixed position between said ramp means and said stops, and a pressure roller rotatably mounted to one end of a crank arm, the other end of said crank arm being rigidly mounted to a second rotatable shaft, said second shaft being controlled by a second solenoid wherein said pressure rollers engage the collation and apply a force against said driven rollers when said second solenoid is activated whereby the lead edge of the sheets of the collation remain in vertical alignment after said stop bars have pivoted away and said feed rollers are transporting the collation out of the stacking area.

* * * * *